United States Patent [19]

Nieratschker

[11] Patent Number: 4,792,289

[45] Date of Patent: Dec. 20, 1988

[54] RECIPROCATING PUMP FOR CRYOGENIC FLUIDS

[75] Inventor: Willi Nieratschker, Ammerbuch, Fed. Rep. of Germany

[73] Assignee: Deutsche Forschungs- und Versuchsanstalt fur Luft- und Raumfahrt e.V., Bonn, Fed. Rep. of Germany

[21] Appl. No.: 63,125

[22] Filed: Jun. 17, 1987

[30] Foreign Application Priority Data

Jun. 28, 1986 [DE] Fed. Rep. of Germany ..... 3621727

[51] Int. Cl.[4] ..... F04B 3/00; F04B 15/08

[52] U.S. Cl. ..... 417/259; 417/511; 417/901; 417/DIG. 1; 92/144; 92/170; 92/172

[58] Field of Search ..... 417/259, 901, DIG. 1, 417/444, 511, 514; 92/144, 170, 169, 172, 222, 226, 248

[56] References Cited

U.S. PATENT DOCUMENTS

| | | | |
|---|---|---|---|
| 1,671,310 | 5/1928 | Pence | 92/222 |
| 2,250,419 | 7/1941 | Johnston et al. | 92/144 |
| 2,292,617 | 8/1942 | Dana | 92/144 |
| 2,888,879 | 6/1959 | Gaarder | 92/170 X |
| 3,055,764 | 9/1962 | Pryor et al. | 417/444 X |
| 3,489,130 | 1/1970 | Polidan et al. | 92/169 X |
| 4,156,584 | 5/1979 | Schuck | 417/901 X |
| 4,239,460 | 12/1980 | Gölz | 417/259 X |
| 4,393,752 | 7/1983 | Meier | 417/901 X |
| 4,396,362 | 8/1983 | Thompson et al. | 417/53 X |
| 4,594,939 | 6/1986 | Van Os | 92/172 X |
| 4,639,197 | 1/1987 | Tornare et al. | 417/259 |

FOREIGN PATENT DOCUMENTS

| | | | |
|---|---|---|---|
| 3342381 | 6/1985 | Fed. Rep. of Germany | 417/901 |
| 8201683 | 11/1983 | Netherlands | 92/170 |

OTHER PUBLICATIONS

Gottzman, C. F., High Pressure Liquid-Hydrogen and -Helium Pumps AICE, Advances in Cryogenic Engineering, vol. 5, 1960, pp. 289–298.

Schweizerische Bauzeitung, Jul. 4, 1963, pp. 496–497.

*Primary Examiner*—Paul F. Neils

*Attorney, Agent, or Firm*—Wolf, Greenfield & Sacks

[57] ABSTRACT

In a reciprocating pump for cryogenic fluids comprising a pump cylinder in which a piston is oscillatingly displaceable in a sealed state, an inlet valve and an outlet valve, and an annular channel surrounding the pump cylinder on the outer side and forming an outlet for the cryogenic fluid delivered by the pump, in order to attain optimum sealing at the operating temperatures, without the piston motion being impeded at higher temperatures, it is proposed that the cylinder be made of a material with good sliding and self-lubricating properties and a thermal expansion coefficient which is larger than that of the piston, that the dimensions of the cylinder and the piston be so selected that the piston sealingly contacts the inside wall of the cylinder at operating temperature, and that the outlet valve be arranged at the downstream end of the annular channel.

7 Claims, 2 Drawing Sheets

RECIPROCATING PUMP FOR CRYOGENIC FLUIDS

The invention relates to a reciprocating pump for cryogenic fluids comprising a pump cylinder in which a piston is oscillatingly displaceable in a sealed state, an inlet valve and an outlet valve, and an annular channel surrounding the pump cylinder on the outer side and forming an outlet for the cryogenic fluid delivered by the pump.

Reciprocating pumps of this kind are used to pump cryogenic fluids, for example, liquid nitrogen or liquid hydrogen (C. F. Gottzmann, High-Pressure Liquid Hydrogen and Helium Pumps, AICE, Advances in Cryogenic Engineering, Volume 5, 1960, pages 289 to 298).

In the pumping of cryogenic fluids, difficulties are caused by the boiling state of the media to be pumped, their low temperatures and their low kinematic viscosity. The low temperatures limit the choice of materials to a considerable extent, lead to shrinkage problems, in particular, in the pairing of piston and cylinder and prevent use of additive lubricants. The low kinematic viscosity of the fluid to be pumped also means a low lubricating property and one is, therefore, dependent on self-lubricating surfaces of piston and cylinder. Accordingly, the compression space can be sealed either by surfaces with self-lubricating properties or by so-called gas-cushioned or non-contacting seals.

In contradiction with the sealing, friction losses between piston and cylinder are to be kept to a minimum since any heat input results in the formation of vapor bubbles. This should be avoided as far as possible in order to maintain operability of the pump. Depending on the end delivery pressure and the volumetric efficiency, gas components of approximately 15 to 20% by volume can be tolerated. In solid piston pumps as described, for example, in U.S. Pat. Nos. 4,156,584 and 4,396,362, the vaporized component is returned to the storage container or feed pipe via a leak pipe. In reciprocating pumps (German unexamined Patent Application No. 3,342,381) with a hollow piston, a leak pipe is not required as the fluid vaporized by friction in the gap during the work stroke can flow back into the suction space and is carried along with the next work stroke.

A further essential aid is the cooling of the cylinder wall either by the leak component which has already vaporized in any case (U.S. pat. No. 4,396,362) or by the main flow through the pump body on the pressure side (U.S. Pat. No. 4,156,584). The accumulation of heat in the cylinder wall is thereby avoided. It is carried away together with the cryogenic fluid. It is much less critical for the cryogenic medium to be subjected to heat downstream from the compression space than in the suction space since, in particular, downstream from the outlet valve, heat input even has a pressure increasing effect. More particularly, once the critical pressure is exceeded there is no longer any danger of a two-phase flow.

For the aforesaid reasons, the following materials are suitable for the important parts of a pump, i.e., piston, cylinder and sealing rings: austenitic steels, for example, austenitic steels which are tough at low temperatures, Fe Ni 36, bronze, PTFE (polytetrafluorethylene), PTFE-carbon, PTFE-bronze, PTFE-graphite, ceramic material, carbon-fiber-reinforced plastic.

While relatively little research has been done on ceramic material and carbon-fiber-reinforced plastic, known pump pistons and pump cylinders are mostly made of austenitic steels which are tough at low temperatures or Fe Ni 36. the compression space is sealed by piston rings made of PTFE-graphite or PTFE-carbon. Both materials have extremely good sliding properties with respect to steel and, in addition, self-lubricating properties. The high thermal expansion coefficient is disadvantageous. When cooled from ambient temperature to 77K, the thermal expansion of PTFE is six to seven times higher than in high-grade steel and almost forty times higher than in Fe Ni 36 steel. The radial shrinking of the PTFE piston rings is, therefore, critical.

With slotted piston rings, the shrinkage can be compensated by spring pretensioning by means of beryllium-copper springs, but the leak through the slot and the high manufacturing expenditure are disadvantageous.

With unslotted PTFE piston rings, the gap between piston and cylinder which increases in size during the cooling-down can be reduced by a combination of several measures:

1. the piston ring thickness is reduced as far as technically possible in order to reduce the absolute shrinkage;
2. by shrink-fitting the piston ring on an Fe Ni 36 piston, the internal diameter of the piston ring remains practically constant during cooling-down so that the lateral contraction is the only decisive factor;
3. by using austenitic steels which are tough at low temperatures as cylinder material, the gap is finally reduced to the difference between the lateral contraction of the PTFE and the shrinkage of the cylinder made of austenitic low-temperature-tough steel.

The gap obtainable by such measures is still too large for high-pressure pumps (pressure increase $>10$ bar). A further possibility is to install the cold piston with piston rings which at ambient temperature are over-dimensioned in relation to the cylinder. However, there is the disadvantage that in the warm state the piston seizes in the cylinder and, therefore, motion of the piston in the warm state is not possible. Also, plastic deformations of the piston rings cannot be excluded.

It is also possible to coat the piston with a layer of PTFE. In this case, adherence to the tolerance in the spraying of the piston and wear life of the layer (layer thickness 15 to 40 $\mu$m) when subjected to abrasion are critical.

Departing from the state of the art constituted by U.S. Pat. No. 4,156,584, the object underlying the invention is to provide a reciprocating pump construction which enables optimum sealing at operating temperature without using piston rings and without restricting movability of the piston in the warm state.

This object is attained, in accordance with the invention, in a reciprocating pump of the kind described at the outset by the cylinder being made of a material with good sliding and self-lubricating properties and a thermal expansion coefficient which is larger than that of the piston, by the dimensions of the cylinder and the piston being so selected that the piston sealingly contacts the inside wall of the cylinder at operating temperature and by the outlet valve being arranged at the downstream end of the annular channel.

Accordingly, the use of piston rings is totally eliminated in the inventive construction. Sealing is achieved by the entire pump cylinder being made of a material which is normally used for the piston rings. The dimensions are selected so as to obtain optimum sealing at operating temperature. Since the materials used for the cylinder exhibit a substantially higher thermal expansion than the piston, the gap between the piston and the inside wall of the cylinder increases during the heating-up. This does influence operation of the pump to a slight extent, but there is neither the danger of seizing of the piston nor the danger of deformation of the parts used. It is even advantageous for cryogenic fluid to flow through the slight gap between the piston and the inside wall of the cylinder during the cooling cycle of the pump as this accelerates cooling-down of all of the parts.

Since the materials used to manufacture the cylinder exhibit substantially less strength than conventional cylinder materials a further measure is taken to arrange the outlet valve at the downstream end of the annular channel so that the same high pressure exists in the annular channel as in the interior of the pump cylinder. In this way, the cylinder is acted upon by the same pressure from the inside and the outside so that, in all, the mechanical stress to which the cylinder is subjected is reduced to a minimum. In addition, the forces acting inwardly on the cylinder from the outside, at least in the region of the suction space, are greater than the forces acting outwardly from the inside and the cylinder is, therefore, sealingly pressed against the piston from the outside. This measure also improves the sealing between the piston and the inside wall of the cylinder.

A further advantage is obtained by the surface of the self-lubricating inside wall of the cylinder which is swept by the piston and corresponds to the stroke of the piston being considerably larger than a corresponding contact surface of a piston ring on a conventional cylinder as this enables the abrasion and wear of the self-lubricating material to be substantially reduced.

The cylinder preferably consists of PTFE, PTFE-graphite, PTFE-bronze, PTFE-carbon, carbon-fiber-reinforced plastic or brass while the piston preferably consists of high-grade steel with low thermal expansion, in particular, austenitic steels which are tough at low temperatures or Fe Ni 36.

In a preferred embodiment, provision is made for the piston to comprise on its jacket surface one or several annular shoulders which sealingly abut the inside wall of the pump cylinder. Such seals which are essentially linear reduce the friction between piston and cylinder wall and thus also the undesired heat generated during the pumping operation.

In order to form an annular shoulder, a spherical shape may be imparted to the piston in the region of this annular shoulder by a grinding operation.

In a further preferred embodiment, the piston is hollow and open at one side, and an opening which is closable by a check valve is arranged in the piston. The advantage of using such a hollow body is that the mass of the piston to be cooled is small, which enables particularly rapid cooling-down. This is promoted by the cryogenic fluid flowing over the outer side and the inner side of this piston during the cooling-down and, furthermore, by the cryogenic fluid likewise flowing over the inner side and the outer side of the pump cylinder during the cooling-down.

It is particularly advantageous for the annular channel to have such small dimensions in the radial direction that the volume of the annular channel is low in relation to the amount of fluid delivered per piston stroke. In this way, an increased flow velocity in the annular channel and thus a particularly effective withdrawal of heat from the pump cylinder are achieved.

One end of the pump cylinder may be shrunk-fit on a cylinder head while its opposite end terminates freely in a region where the pumped fluid flows over it.

The following description of preferred embodiments serves in conjunction with the appended drawings to explain the invention in greater detail. In the drawings.

Figure 1:
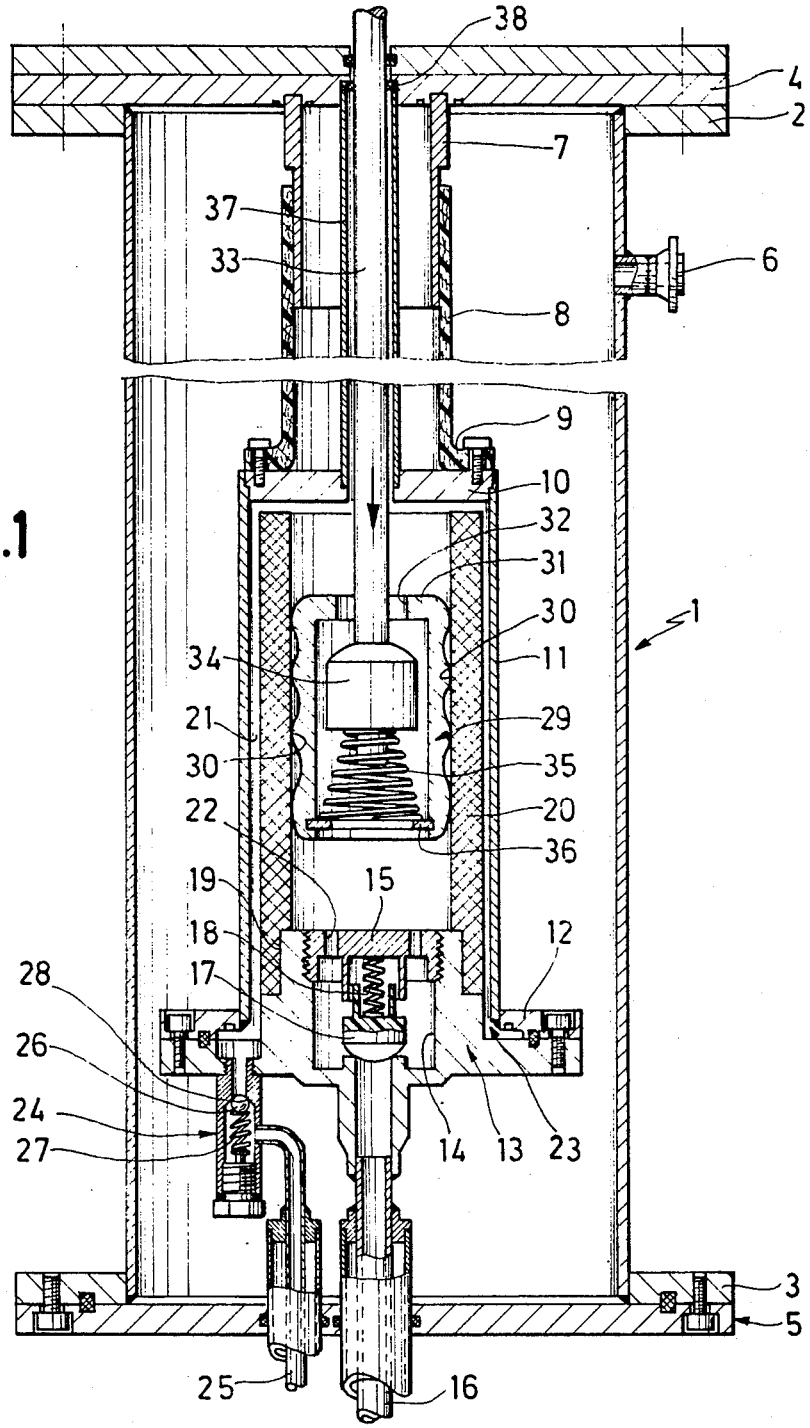
FIG. 1 is a longitudinal sectional view through a reciprocating pump for cryogenic fluids with closed inlet and outlet valves.

The reciprocating pump illustrated in the drawings comprises a cylindrical vacuum container 1 with flanges 2 and 3 at the upper and lower sides, respectively. Covers 4 and 5 are sealingly screwed to these flanges 2 and 3, respectively. The interior of the vacuum container can be evacuated through a closed lateral connection 6. A pipe 8 made of a glass-fiber-reinforced plastics material is pushed onto a metal sleeve 7 held at the center of the upper cover 4 and affixed thereto by, for example, adhesion. The free end 9 of pipe 8 which is bent outwardly to form a flange is screwed to a cover plate 10 which, in turn, closes off a thin-walled external cylinder 11 on the upper side. This external cylinder 11 is sealingly screwed at the lower side to a cylinder head 13 by a fastening ring 12.

The cylinder head 13 protrudes into the lower part of external cylinder 11 and comprises in this region a centrally arranged valve chamber 14 into the upper side of which a valve holder 15 is screwed. A vacuum-insulated suction line 16 extending in a sealed manner through the lower cover 5 of the vacuum container 1 opens into the valve chamber 14 on its lower side. The entrance of the suction line 16 into the valve chamber 14 is designed as valve seat for a spherical-cap-shaped valve body 17 which is guided in the valve holder 15 and is pressed against the valve seat by a beryllium-copper spring 18. The valve body 17 can be lifted off the valve seat against the action of the spring 18.

The part of the cylinder head 13 protruding into the external cylinder 11 comprises at its upper end a stepped recess 19. Shrunk-fit on the cylinder head 13 in this region is a pump cylinder 20 which is open on either side and forms between its external wall and the internal wall of the external cylinder 11 a radially narrow annular channel 21. The end of the pump cylinder 20 opposite the cylinder head 13 is freely arranged at a short distance from the cover plate 10 so that the interior of the pump cylinder 20 is in flow communication with the annular channel 21. The interior of the pump cylinder 20 also communicates with the valve chamber 14 through apertures 22 in the valve holder 15.

The annular channel 21 opens into a radially enlarged annular space 23 machined in the fastening ring 12. Disposed on the lower side of the cylinder head 13 is an outlet valve 24 connecting the annular space 23 with a discharge line 25 which likewise extends through the lower cover 5 and is vacuum-insulated. The outlet valve 24 comprises a spherical valve body 26 which is pressed by a spring 27 against a valve seat 28.

Arranged in the interior of the pump cylinder 20 is a hollow piston 29 comprising on its external jacket several axially spaced spherical regions 30 shaped by a grinding operation. These abut with their largest circumferential portion the inside wall of the pump cylinder 20. The hollow piston 29 is open on one side and comprises in an end wall 31 on the opposite side a through-opening 32 through which a push-pull rod 33 extends. This push-pull rod 33 carries in the interior of the hollow piston 29 a valve body 34 against which a compression spring 35 is supported. The other end of the compression spring rests on a retaining ring 36 at the open end of the hollow piston 29. The compression spring 35 pushes the valve body 34 in the direction of the through-opening 32. When the valve body 34 rests against the through-opening 32 it closes it.

The push-pull rod is guided through the cover plate 10 of the external cylinder 11 and is surrounded in the region of pipe 8 and metal sleeve 7 by a thin metal pipe 37. In the upper cover 4, this metal pipe 37 is sealed by an annular seal 38 from the push-pull rod 33 extending upwardly through the cover 4. A reciprocating drive, not depicted in the drawings, for the push-pull rod is arranged on the upper side of cover 4.

The hollow piston 29 consists of a metal with low thermal expansion, for example, austenitic steel which remains tough at low temperatures or of Fe Ni 36. In contrast, the pump cylinder 20 is made of a material having, on the one hand, good sliding and self-lubricating properties compared with the piston material and, on the other hand, a much greater thermal expansion than the piston material. The pump cylinder may, for example, consist of PTFE, PTFE-graphite, PTFE-bronze, PTFE-carbon, carbon-fiber-reinforced carbon or brass. The dimensions of the piston and the pump cylinder are chosen so that at operating temperature, i.e., the temperature of the pumped cryogenic fluid, the piston sealingly abuts the inside wall of the pump cylinder 20 in the spherical regions 30 shaped by a grinding operation, whereas a gap occurs between hollow piston 29 and pump cylinder 20 at higher temperatures.

Figures 2, 3:
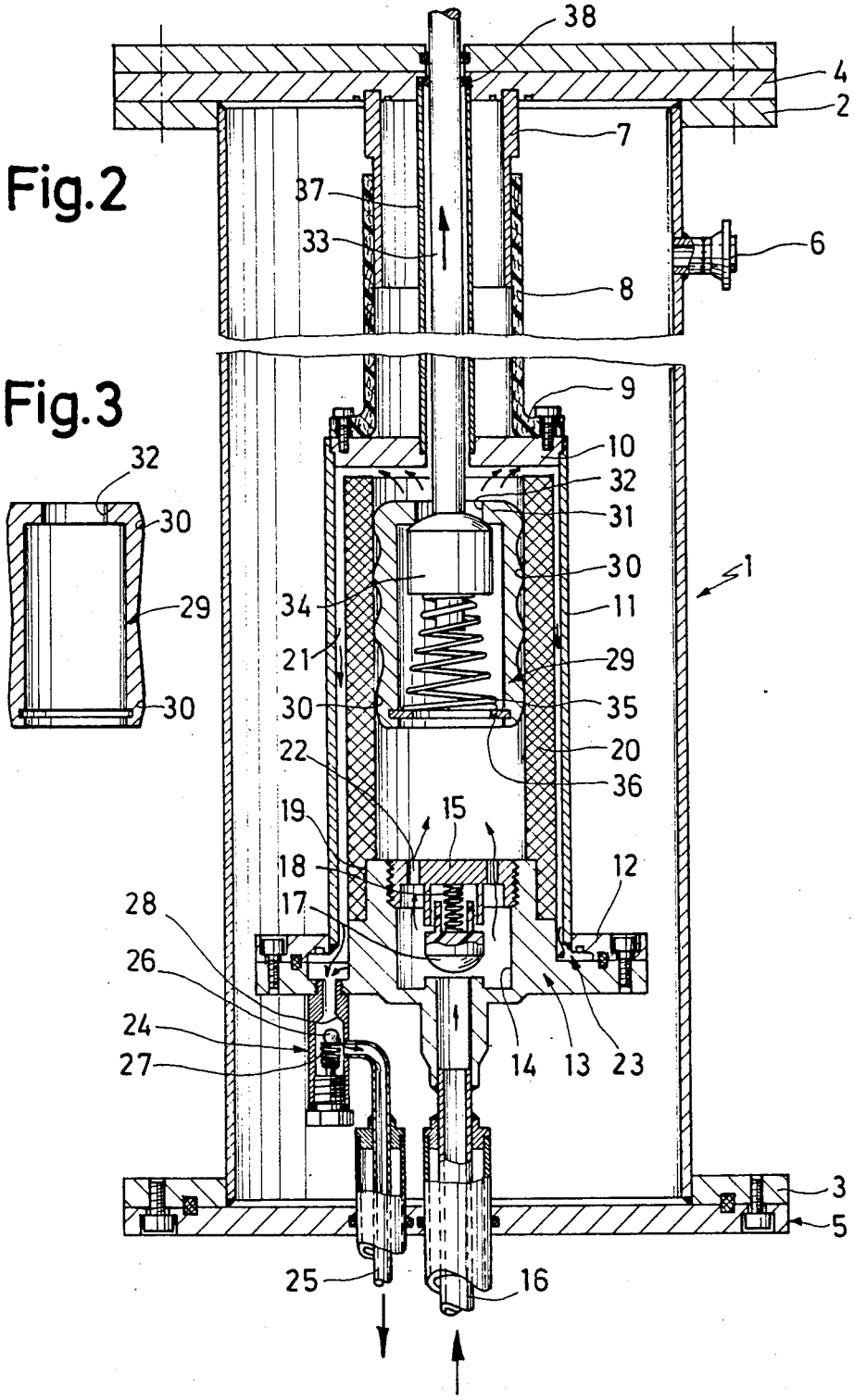
FIG. 2 is a view similar to FIG. 1 with open inlet and outlet valves.
FIG. 3 is a sectional view through a further preferred embodiment of a piston.

The pump illustrated in FIGS. 1 and 2 operates in the following manner: In a downward stroke during which the push-pull rod 33 is pushed downwardly, the valve body 34 is lifted off the through-opening 32 so that the fluid in the interior of the pump cylinder 20 travels from the open lower side of the hollow piston 29 through the through-opening 32 to the upper side of the hollow piston 29 (FIG. 1). In an upward stroke during which the push-pull rod 33 is pulled upwardly, the through-opening 32 in the hollow piston 29 is closed by the valve body 34. During this stroke, both the inlet valve (valve body 17) and the outlet valve 24 (valve body 26) are opened so that the fluid to be pumped is drawn into the part of pump cylinder 20 located below the hollow piston 29 through suction line 16, and, at the same time, the fluid is delivered to the discharge line 25 from the pump cylinder 20 arranged above the hollow piston 29 through the annular channel 21 and the open outlet valve 24 (FIG. 2). An important requirement for operation of the illustrated reciprocating pump is that there should always be the high pressure of the pressure side in the annular channel 21 so that the pump cylinder 20 is always acted upon inwardly by this pressure exerted from the outside. In the region above the hollow piston 29, the pressure forces acting on the pump cylinder, therefore, balance each other out to a substantial degree, whereas in the region below the hollow piston 29 (suction space) the forces acting inwardly from the outside predominate. In this way, the pump cylinder 20 consisting of low-resistance material is not stressed radially outwardly, but, at most, radially inwardly and, at the same time, sealing between t and the piston is improved.

The fluid flowing along the inside and the outside of the pump cylinder 20 effectively cools the pump cylinder and carries off heat caused by the friction on the pressure side.

There is optimum sealing between piston and pump cylinder at operating temperature. At higher temperatures a minimal leakage occurs, however, this is not detrimental, but rather results in accelerated cooling-down when the pump is started up.

Arrangement of the pump in a vacuum container enables it to be operated in a non-immersed state. The only heat conducting bridges in the outward direction are the vacuum-insulated suction line 16, the likewise vacuum-insulated discharge line 25, the push-pull rod 33 with the pipe 37 enclosing it and the glass-fiber-reinforced plastic pipe 8 fitted on it. These thermal bridges are so designed that, in all, the thermal insulation of the actual pump unit from the environment is excellent. The push-pull rod 33 is sealed in the region of the upper cover 4, i.e., at higher temperatures, and, therefore, very effective sealing is possible there. In the interior of the metal pipe 37, the push-pull rod 33 is surrounded by a gas cushion which remains substantially unaltered there. The gas-filled idle volume between the metal pipe 37 and the push-pull rod 33 is kept as small as possible.

While the hollow piston 29 illustrated in FIGS. 1 and 2 comprises in the axial direction four spherical regions 30, shaped by a grinding operation, the modified hollow piston illustrated in FIG. 3 has only two spherical regions 30, shaped by a grinding operation, at the upper and lower ends of the hollow piston. Excellent sealing between piston and pump cylinder at operating temperature is also achieved with this invention piston design.

It will be understood that pistons of a different design may also be used, for example, pistons given a cylindrical shape by a grinding operation or compact pistons without a through-opening closed by a valve.

What is claimed is:

1. In a reciprocating pump for cryogenic fluids having a pump cylinder in which a piston is oscillatingly displaceable in a sealed state, and an inlet valve and an outlet valve, the improvement comprising:

an annular channel surrounding the pump cylinder on the outer side and forming an outlet flow path for the compressed cryogenic fluid delivered by the pump to balance the radially directed fluid forces acting on said pump cylinder;

said pump cylinder being made of a material which has good sliding and self-lubricating properties and a thermal expansion coefficient which is larger than that of said piston;

the dimensions of said pump cylinder and said piston being selected that said piston sealingly contacts the inside wall of said pump cylinder at operating temperature; and said outlet valve being arranged at the downstream end of said annular channel.

2. Reciprocating pump as defined in claim 1, characterized in that:

said pump cylinder consists of PTFE-graphite, PTFE-bronze, PTFE-carbon, carbon-fiber-reinforced plastic or brass.

3. Reciprocating pump as defined in claim 1, characterized in that:

said piston consists of high-grade steel or Fe Ni 36 with low thermal expansion.

4. Reciprocating pump as defined in claim 1, characterized in that:

said piston is hollow and open on one side, and in that:

an opening closable by a check valve is arranged in said piston.

5. Reciprocating pump as defined in claim 1, characterized in that:

said annular channel is of such small dimensions in the radial direction that the volume of said annular channel is low in relation to the amount of fluid delivered per piston stroke.

6. Reciprocating pump as defined in claim 1, characterized in that:

said piston comprises on its jacket surface annular shoulders which sealingly abut the inside wall of said pump cylinder.

7. Reciprocating pump as defined in claim 4, characterized in that:

in order to form an annular shoulder, said piston is given a spherical shape in the region of this annular shoulder.

* * * * *